United States Patent [19]

Grethe

[11] Patent Number: 4,602,575

[45] **Date of Patent: * Jul. 29, 1986**

[54] METHOD OF BURNING PETROLEUM COKE DUST

[75] Inventor: Klaus Grethe, Gummersbach, Fed. Rep. of Germany

[73] Assignee: L. & C. Steinmüller GmbH, Gummersbach, Fed. Rep. of Germany

[ * ] Notice: The portion of the term of this patent subsequent to Aug. 21, 2001 has been disclaimed.

[21] Appl. No.: 629,629

[22] Filed: Jul. 11, 1984

[30] Foreign Application Priority Data

Jul. 12, 1983 [DE] Fed. Rep. of Germany ..... 3325065

[51] Int. Cl.[4] ..... F23D 1/00

[52] U.S. Cl. ..... 110/347; 110/263; 110/264

[58] Field of Search ..... 110/347, 263, 264

[56] References Cited

U.S. PATENT DOCUMENTS 4,333,405 6/1982 Michelfelder et al. ..... 110/264

4,466,363 8/1984 Leikert et al. ..... 110/347

*Primary Examiner*—Edward G. Favors

*Attorney, Agent, or Firm*—Becker & Becker, Inc.

[57] ABSTRACT

A method of burning petroleum coke dust in a burner flame having an intensive internal recirculation zone. The petroleum coke dust is supplied to that region of the intensive recirculation zone which provides the ignition energy for the petroleum coke dust which is to be burned.

3 Claims, 2 Drawing Figures

METHOD OF BURNING PETROLEUM COKE DUST

BACKGROUND OF THE INVENTION

1. Field of the Invention

The present invention relates to a method of burning petroleum coke dust in a burner flame having an intensive internal recirculation zone.

2. Description of the Prior Art

In the petrochemical industry, residues, such as petroleum coke, are produced which have a very high heating value and are therefore preferred for utilization of the thermal energy contained therein. In addition to the high heating value of approximately 32 MJ/kg, petroleum coke is also characterized by a low ash content of about 0.5 to 5% by weight. Despite the high heating value and the low ash content, the petroleum coke is not capable of ignition due to relatively small components of volatile constituents. Measures therefore must be taken, especially with regard to combustion, which assure a reliable ignition and subsequently a stable combustion.

As tests have shown, petroleum coke dust can be burned utilizing burners with which the prerequisites for the ignition of the petroleum coke dust and for a subsequent stable combustion are possible. The significant criterion for the burners utilized is the presence of a so-called internal recirculation zone of the burner flame, via which the ignition energy is delivered.

In a manner similar to coal dust, the petroleum coke can be burned in pulverized or dust form. The ignition energy can be delivered in one or two ways. The first way comprises providing the ignition energy via the internal recirculation zone from an independent energy carrier, for example natural gas. The second way comprises delivering the ignition energy from the petroleum coke dust itself, although in order to ignite the petroleum coke dust, special ignition conditions must be provided in the recirculation zone which is formed. Measures also must be provided which assure a stable and complete combustion subsequent to ignition.

It is therefore an object of the present invention to provide a method of being able to burn petroleum coke dust in a stable manner in burners of conventional construction in an internal recirculation zone of the burner flame.

BRIEF DESCRIPTION OF THE DRAWING

This object, and other objects and advantages of the present invention, will appear more clearly from the following specification in conjunction with the accompanying drawing, in which.

SUMMARY OF THE INVENTION

The method of the present invention is characterized primarily by the step of supplying the petroleum coke dust into the region of the intensive recirculation zone, which provides the ignition energy for the petroleum coke dust which is to be burned.

Pursuant to a first procedural method, the ignition energy for igniting the petroleum coke dust is provided by a gas flame, so that the entire combustion process is continuously supported by the independent energy carrier gas.

Pursuant to a second procedural method, the so-called independent energy carrier is omitted, and the petroleum coke dust itself is used as the ignition energy carrier. In this case, however, combustion should be in the recirculation zone, which delivers the ignition energy and which assures the stable combustion in the primary region. The present invention provides for conducting the combustion in the recirculation zone at less than stoichiometric conditions; in other words, the quantity and velocity of the secondary air are reduced. First of all, the ignition process can be reliably initiated with these measures. Furthermore, care must be taken for the stable and complete combustion of the secondary zone of the flame. The present invention therefore provides for the supply to this area of that quantity of combustion air which is necessary for complete and stable combustion. This combustion air is designated as so-called incremental air in German Pat. No. 29 08 427, and is utilized in a burner pursuant to German Pat. No. 29 08 448.

During combustion tests with different types of petroleum coke, there was discovered that in the primary zone of the coke flame, a considerably smaller quantity of the oxygen for combustion reacts with the combustion material than is the case with coal dust flames. Therefore, a smaller quantity of the secondary combustion air can be supplied to the primary zone, resulting in an increase of the temperature to that value required for ignition of the petroleum coke dust. This increase in temperature is enhanced by the reduction of the exit velocity of the secondary air. These measures result in a combustion at less than stoichiometric conditions in the region of the inner recirculation zone at an air ratio coefficient of approximately 0.6, which assures a stable ignition of the petroleum coke dust.

Depending upon the magnitude of the temperatures of the flue gases which flow back about the flame at the root thereof due to external recirculation, if the temperatures are too low, there is further proposed pursuant to the present invention that mixing of flue gases, which are too cold and which would reduce the available ignition energy, are prevented from mixing with the root of the flame via expanding the internal recirculation zone by extending the depth of the cup-shaped portion of the burner, i.e. the burner quarl, in the axial direction of the burner flame.

DESCRIPTION OF PREFERRED EMBODIMENTS

Figure 1:
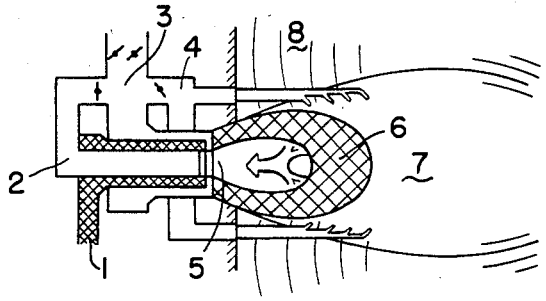
FIG. 1 is a diagrammatic illustration of a burner having a flame with an internal recirculation zone.

Referring now to the drawing in detail, shown in FIG. 1 is a burner which comprises a core-air pipe 2, a fuel and carrier air section 1, and a mantle or outer air section 3. The burner produces a partial combustion zone (primary zone) 6, the air coefficient of which, i.e. the ratio of the mass of supplied air to the mass of air during stoichiometric combustion, is approximately 0.6 times the stoichiometric value.

The burner is designed in such a way that by means of certain measures (swirl of the outer air, conically expanded burner opening, closed core air), a zone of intense return flow or recirculation 5 is produced in the interior of the flame from an area of combustion which is already in progress. Consequently, the fuel-air mixture is rapidly heated up and ignited.

The air required for burning what remains is blown in along the periphery via a number of nozzles as residual air (incremental air) 4 in such a way that only after formation of the primary flame does it supply oxygen to the secondary flame or also to the afterburner or secondary combustion zone 7. For this purpose, the incremental air nozzles are disposed in a partial circle having a diameter which corresponds to that of the double outer air pipe. This assures that the incremental air 4 only reaches the actual flame downstream of the burner opening after having traveled a distance of approximately 1 to 2 outer-air pipe diameters.

Figure 2:
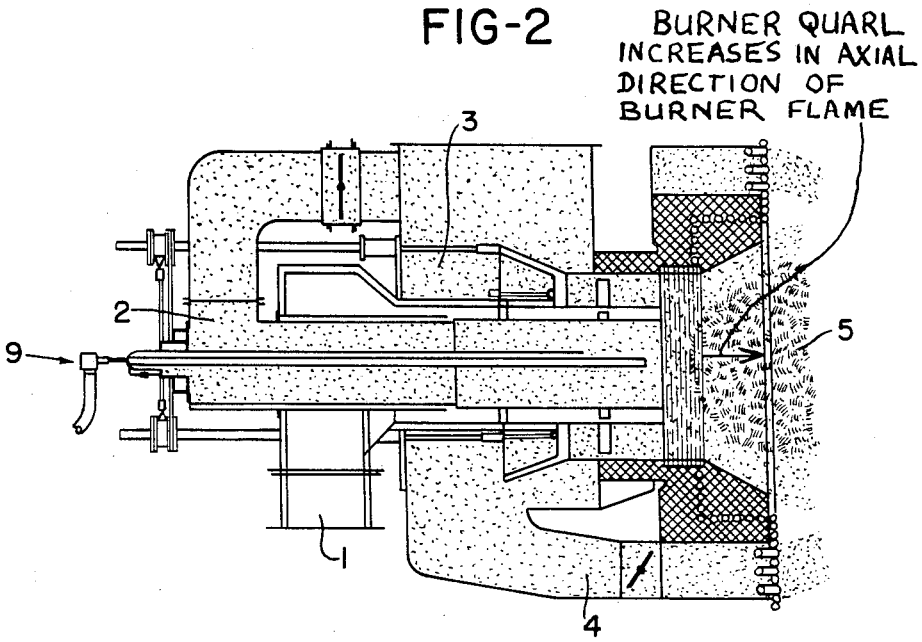
FIG. 2 is a fragmentary sectional view taken through a burner which can be used for the inventive method, with appropriate means for supplying air and fuel also being shown.

FIG. 2 shows the flow of fuel and combustion air in conjunction with a burner with which the ignition energy for the petroleum coke dust, that is to be burned, is delivered from a support flame which is independently operated from external energy, and which has an internal recirculation zone 5. The gas lance 9 located in the core-air pipe 2 serves to produce the support flame. Start of the petroleum coke dust combustion is effected with the start of the gas support flame accompanied by supply of the entire secondary air 3 and the incremental air 4. Subsequently, the petroleum coke dust is supplied to the combustion along with the primary air, which together are designated as the carrier air 1.

The embodiment of a burner shown in FIG. 2 also can be used for combustion which occurs or proceeds without external ignition energy support. In such a case, however, the gas lance 9 is used only for initial ignition of the petroleum coke dust combustion. The reduction of the quantity and the velocity of the secondary air 3 leads to the aforementioned stable ignition and complete combustion of the petroleum coke dust.

The temperatures in the primary zone 6 of the flame are reduced as the result of recirculation of relatively cold flue gases 8. Since a reduction of the temperature in turn adversely affects the ability of the petroleum coke to ignite, measures must be provided to prevent this from happening. One possible inventive solution consists in extending the depth of the cup-shaped portion of the burner, i.e. the burner quarl, so that the primary zone, which delivers the ignition energy, is nearly completely embedded in the burner quarl. This eliminates the negative effects resulting from recirculating cold flue gas.

Depending upon the type of processing which the crude oil has undergone, the petroleum coke can contain harmful materials such as, for example, vanadium, which not only lead to corrosive compounds during combustion in steam generators, but furthermore considerably pollute the environment when they leave the steam generator with the flue gas. When using the embodiment of a burner as described above, these negative effects or harmful occurrences can be extensively avoided by adding vanadium-binding additives to the combustion via the incremental air 4.

The present invention is, of course, in no way restricted to the specific disclosure of the specification and drawing, but also encompasses any modifications within the scope of the appended claims.

What I claim is:

1. A method of burning petroleum coke dust in the flame of a main burner having a cup-shaped burner quarl, at least with carrier air and secondary air, which burner flame has an intensive internal recirculation zone and can encounter mixing with relatively cold flue gases, said method comprising the steps of:

supplying said petroleum coke dust having high heating value and low ash content, although said petroleum coke dust is generally incapable of ignition due to relatively small components of volatile constituents, specifically into the region of said internal recirculation zone;

igniting and burning said petroleum coke dust under less than stoichiometric values in a primary combustion zone nearly completely enveloped in said burner quarl and being of increased length in the axial direction of said flame of said main burner to avoid mixing of cold flue gases, by reducing the quantity and velocity of said secondary air to provide the ignition energy for said petroleum coke dust; and by blowing air necessary for the remaining combustion as residual air into a secondary combustion zone of the burner flame.

2. A method of burning petroleum coke dust in a burner flame which has a root as well as a quarl and which has an intensive internal recirculation zone and can encounter mixing with relatively cold flue gases; said method comprising in combination the steps of:

supplying said petroleum coke dust specifically into the region of said intensive recirculation zone with which burner quarl is extended by increasing depth thereof in the axial direction of said burner flame so that flue gases, which are too cold and which would reduce available ignition energy, are prevented from mixing with the root of the flame via expanding of said internal recirculation zone by extending depth of the burner quarl, which provides reliable ignition energy for stable burning of said petroleum coke dust having high heating value and low ash content although said petroleum coke dust is generally incapable of ignition due to relatively small components of volatile constituents, such burning of said petroleum coke dust being accomplished by providing special ignition conditions for the petroleum coke dust specifically in the intensive recirculation zone; and providing said ignition energy for the petroleum coke dust in the region of said intensive internal recirculation zone via a gas flame so that the entire combustion gas process is continuously supported by independent energy carrier gas.

3. A method of burning petroleum coke dust in a burner flame which includes a root of the flame and which has an intensive internal recirculation zone and can encounter mixing with relatively cold flue gases; said method comprising in combination the steps of:

supplying said petroleum coke dust specifically into the region of said intensive recirculation zone, which provides reliable ignition energy for stable burning of said petroleum coke dust having high heating value and low ash content although said petroleum coke dust is generally incapable of ignition due to relatively small components of volatile constituents, such burning of said petroleum coke dust being accomplished by providing special ignition conditions for the petroleum coke dust specifically in the intensive recirculation zone;

carrying out said burning of said petroleum coke dust at less than stoichiometric values in order to effect said provision of said ignition energy for the petroleum coke dust in the region of said intensive internal recirculation zone at an air ratio coefficient of predetermined value which assures a stable ignition of the petroleum coke dust;

reducing the quantity and velocity of a secondary air supply to provide ignition energy for said petroleum coke dust; and extending said internal recirculation zone by increasing the depth of the burner quarl in the axial direction of said burner flame so that flue gases, which are too cold and which would reduce available ignition energy, are prevented from mixing with the root of the flame via expanding of said internal recirculation zone by extending the depth of the burner quarl, in the axial direction of the burner flame to avoid mixing of cold flue gases.

* * * * *